US005129356A

United States Patent [19]

Bandy et al.

[11] Patent Number: 5,129,356

[45] Date of Patent: Jul. 14, 1992

[54] FLUID APPLICATOR

[75] Inventors: Bruce A. Bandy, Floyds Knobs, Ind.; James W. Sullivan, Elizabethtown; Philip C. Willis, Louisville, both of Ky.

[73] Assignee: Brown & Williamson Tobacco Corporation, Louisville, Ky.

[21] Appl. No.: 793,493

[22] Filed: Nov. 14, 1991

Related U.S. Application Data

[63] Continuation of Ser. No. 536,124, May 29, 1990, abandoned.

[51] Int. Cl.[5] ..... B05C 5/02

[52] U.S. Cl. ..... 118/315; 239/150; 239/DIG. 1; 493/49

[58] Field of Search ..... 118/315, 411; 427/286; 493/41, 49; 239/150, 151, 587, DIG. 1

[56] References Cited

U.S. PATENT DOCUMENTS

| | | | |
|---|---|---|---|
| 2,515,865 | 7/1950 | Fisher | 239/150 X |
| 3,298,353 | 1/1967 | Huffman | 118/411 |
| 3,931,930 | 1/1976 | Waldrum | 239/DIG. 1 |
| 4,036,114 | 7/1977 | Luke | 118/68 X |
| 4,281,671 | 8/1981 | Bynre et al. | 493/49 X |
| 4,356,216 | 10/1982 | Gailey et al. | 118/411 X |
| 4,501,579 | 2/1985 | Boegli et al. | 493/49 X |
| 4,514,180 | 4/1985 | Manecke | 493/41 |
| 4,575,368 | 3/1986 | Sagawa et al. | 493/49 |

*Primary Examiner*—Richard L. Chiesa
*Attorney, Agent, or Firm*—Charles I. Sherman

[57] ABSTRACT

An applicator for applying multiple lines of a fluid to a substrate includes a manifold having a plurality of fluid flow passages with a like plurality of spaced apart fluid outlets and at least one fluid inlet. Fluid spray nozzles are attached to the manifold in fluid flow communication with the fluid outlets of the manifold. The manifold further includes a swivel mounting for allowing the manifold to pivot about an axis parallel to the spray axes of the spray nozzles.

5 Claims, 3 Drawing Sheets

FLUID APPLICATOR

This is a continuation of copending application Ser. No. 07/536,124 filed on May 29, 1990 now abandoned.

BACKGROUND OF THE INVENTION

1. Field of the Invention

The present invention relates to multiples of spaced apart orifice glue applicators of the type used to apply a like number of glue lines or strips of glue to a moving sheet or web, and more particularly to such a multiple glue applicator wherein the distance between the glue lines or strips being applied can be selectively changed without changing the spacing between orifices.

2. Discussion of the Prior Art

Multiple orifice glue applicators are, per se, known.

Multiple orifice glue applicators are used in various fields wherein it is desirable for one reason or another to apply two or more glue lines to a substrate. For example, U.S. Pat. No. 4,514,180 issued on Apr. 30, 1985 to Kurt A. Manecke discloses a filtered cigarette wherein parallel glue lines are applied to the filter wrapper material to secure the filter wrapper to the underlying filter and to secure the overlapped edges of the filter wrapper to each other.

Examples of various glue applicators are shown in the following U.S. patents.

U.S. Pat. No. 4,036,114 issued on Jul. 19, 1977, to Luke discloses a cigarette filter rod forming apparatus having an adhesive applicator with two nozzle orifices for applying two parallel lines of an adhesive to a filter wrapper material moving through the apparatus.

U.S. Pat. No. 3,298,353 issued on Jan. 17, 1967, to Hoffman discloses a multiple orifice glue applicator having spaced apart fixed position orifices which are selectively blocked by plugs to vary the number and spacing between multiple glue lines. Alternatively, a screw in plug can be used to selectively block off the glue passageway leading supply glue to selected ones of the glue orifices to vary the number and spacing between multiple glue lines.

These heretofore known glue applicants have various drawbacks. For example, the applicator of U.S. Pat. No. 4,036,114 has fixed position nozzle orifices so that the number and spacing between adhesive lines is fixed. The applicator of U.S. Pat. No. 3,298,353 has the drawback that because in order to change the number of glue applying orifices and relative spacings between multiple glue lines, selected orifices are blocked by removable plugs, or the glue passageway to selected orifices is blocked by plugs, the selected spacing between applied glue lines is incrementally fixed. Also, in order to change the number of glue lines to be applied and the spacing between glue lines, the applicator must be removed from operation for an extended period of time and manpower expended in replacing nozzles with plugs and plugs with nozzles.

SUMMARY OF THE INVENTION

The present invention overcomes the drawbacks discussed above in the prior art and provides a multiple orifice glue applicator wherein the distance between applied glue lines can be selectively infinitely changed between limits.

The present invention also provides a glue applicator wherein the spacing between applied glue lines can be changed in a minimum of time.

The present invention further provides a glue applicator wherein the spacing between applied glue lines can be changed, but the position between glue applying nozzles is not changed.

More particularly, the present invention provides a fluid applicator device comprising a manifold having a plurality of fluid flow passages with a like plurality of spaced apart fluid outlets at one side of the manifold and at least one fluid inlet, fluid spray nozzles attached to manifold in fluid flow communication with the fluid outlets of the manifold passages, and swivel mounting means associated with the manifold for allowing the manifold to pivot about an axis parallel to the spray axes of the nozzles.

DETAILED DESCRIPTION OF THE PREFERRED EMBODIMENT

Figure 1:
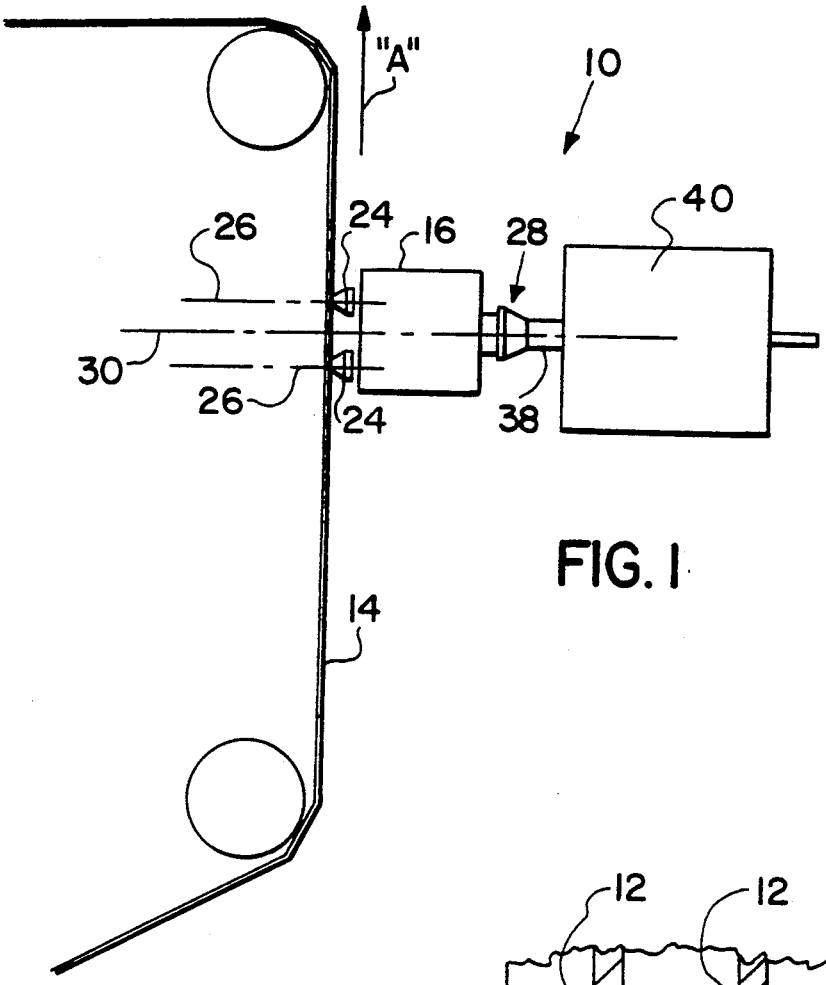
FIG. 1 is a side view of a fluid applicator of the present invention in operation applying parallel lines of fluid to a substrate.
Figure 2:
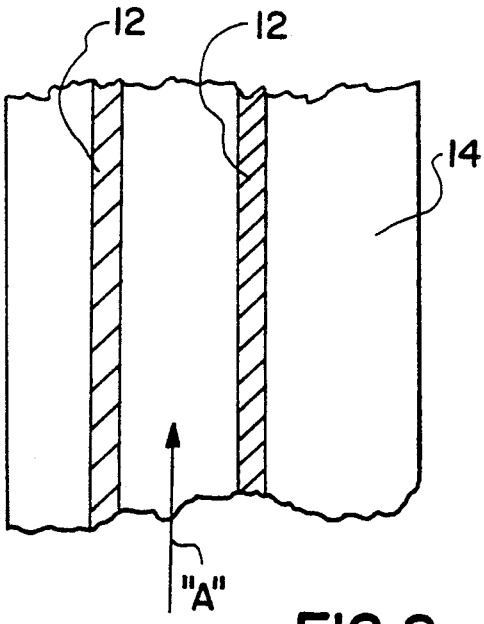
FIG. 2 is a plan view of a substrate having parallel lines of a fluid applied thereon.

With reference to FIGS. 1 and 2, there is shown a fluid applicator, generally denoted as the numeral 10, for applying a plurality of fluid lines 12 to a substrate 14 moving past the applicator 10.

The substrate 14 can be, for example, a web of material used for a cigarette wrapper, and the fluid may be an adhesive or glue. For the sake of brevity and clearness of understanding of the present invention, the substrate 14 and fluid applied by the applicator 10 will not be described because neither forms a part of the invention.

Figure 3:
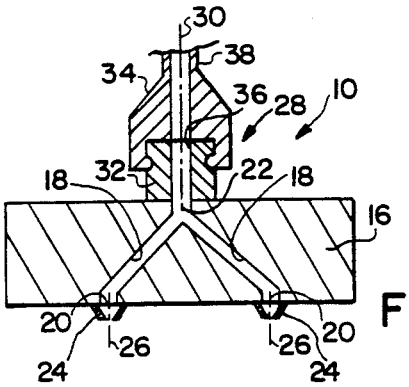
FIG. 3 is a schematic cross-sectional view of the applicator of FIG. 1.

With continued reference to FIGS. 1 and 3, the applicator 10 includes a manifold 16. The manifold 16 is formed with a plurality of fluid flow passages 18 with a like plurality of spaced apart fluid outlets 20 at one side of the manifold 16 and at least one fluid inlet 22 at the other side of the manifold 16. As shown, the manifold 16 is formed with two fluid passages 18 each having a fluid outlet 20, and which merge at a single fluid inlet 22.

Fluid spray nozzles 24 are attached to the manifold 16 in fluid flow communication with the fluid outlets 20 of the manifold fluid flow passages 18. The spray nozzles 24 can be selected, for example, to control the width of the spray of fluid. The spray axes 26 of the spray nozzles 24 are generally parallel to each other.

Swivel mounting means generally denoted as the numeral 28, is structurally associated with the manifold 16 for selectively allowing the manifold to pivot about the axis 30 of the swivel mounting means 26. As shown in FIGS. 1 and 3, the pivot axis 30 of the swivel mounting means 28 is parallel to the spray axes 26 of the spray nozzles 24. More particularly, as shown, swivel mounting means 28 is coaxial with the fluid inlet 22, and the pivot axis 30 lays between the spray axes 26. Preferably, the pivot axis 30 is midway between the spray axes 26. The swivel mounting means 28 can be of various known designs of the type used, for example, for pipe fitting. FIG. 3 illustrates in schematic format a type of swivel mounting means which can be utilized. The swivel mounting means 28 is shown as including a cylindrical boss 32 and a cylindrical coupling 34 attached to the boss 32 providing for rotational movement between the boss 32 and coupling 34. The boss 32 is attached to the manifold 16 and has a central opening 36 therethrough and is coaxially located relative to and in fluid flow communication with the fluid inlet 22 of the manifold fluid flow passages 18.

A fluid supply conduit 38 is used to interconnect a source of fluid 40 and the coupling 34 of the swivel mounting means 28 establishing fluid flow between the source of fluid 40 and the fluid flow passages 18 of the manifold 16.

With reference once again to FIG. 1, in operation, the applicator 10 is positioned next to a moving web of the substrate 14 with the spray nozzles 24 adjacent to and directed at one side of the substrate 14. Thusly, as the web of substrate 14 moves past the applicator 10, the fluid issuing from each nozzle 24 forms a line 12 of the fluid on the substrate 14.

Figure 4:
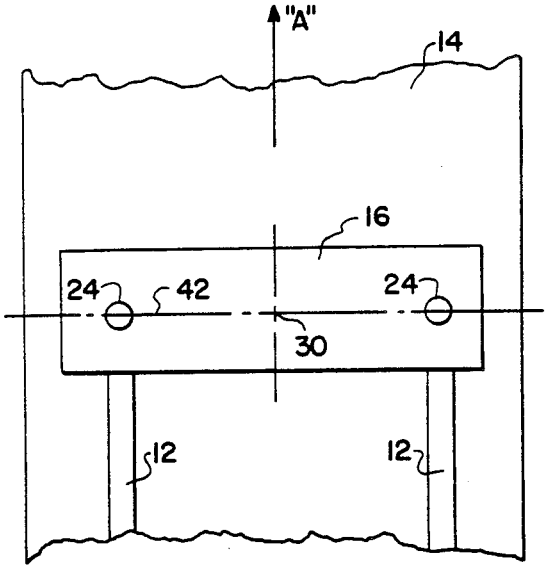
FIG. 4 is a plan view of the applicator of FIG. 1 in one position for applying parallel fluid lines to the substrate with a first distance between the lines.
Figure 5:
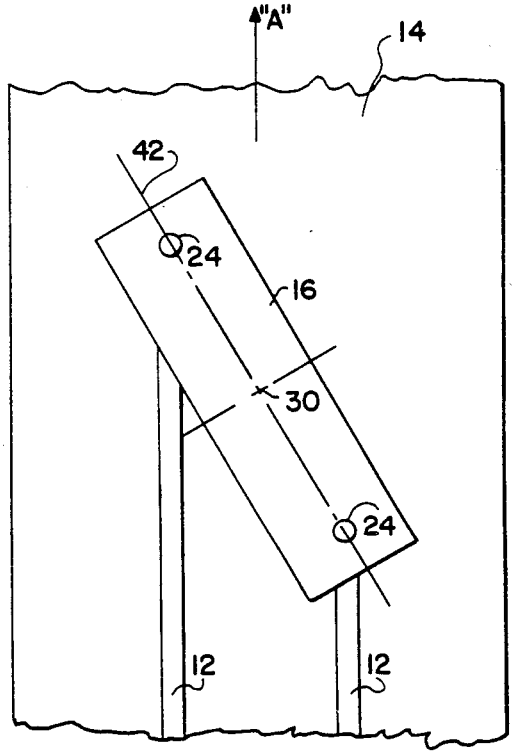
FIG. 5 is a plan view of the applicator of FIG. 1 in another position for applying parallel fluid lines to the substrate with a second distance between the lines.
Figure 6:
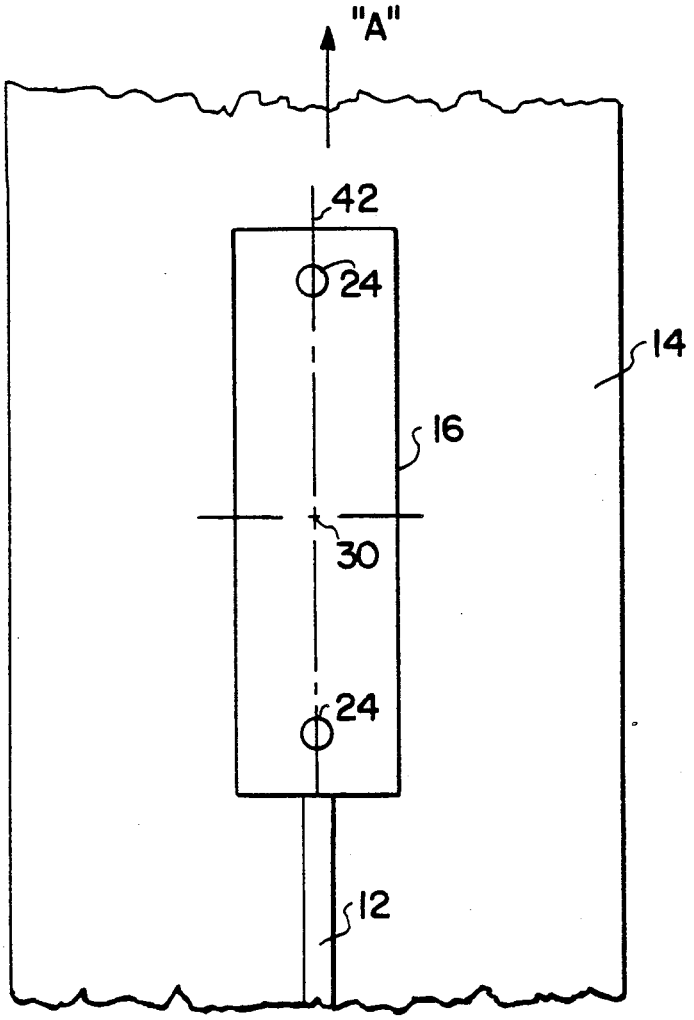
FIG. 6 is a plan view of the applicator of FIG. 1 in yet another position for applying parallel fluid lines to the substrate with a third distance between the lines.

As can be best seen in FIGS. 4 through 6, the distance between the fluid lines 12 formed on substrate 14 can be selectively changed merely by rotating the manifold 16 about the swivel mounting means 28. For example, in FIG. 4, the manifold 16 is positioned about the swivel mounting means 28 such that an imaginary transverse axis 42 between the spray nozzle axes 26 is perpendicular to the direction of movement (indicated by the arrow "A") of the web of substrate 14. This position of the manifold 16 provides a maximum distance between the fluid lines 12 being applied to the substrate 14. In another example, in FIG. 5 the manifold 16 is positioned about the swivel mounting means 28 such that the imaginary transverse axis 42 between the spray nozzle axes 26 is at an acute included angle relative to the direction of movement "A" of the web of substrate 14. This position of the manifold provides a smaller or intermediate distance between the fluid lines 12 being applied to the substrate 14. In yet a further example, in FIG. 6 the manifold 16 is positioned about the swivel mounting means 28 such that the imaginary transverse axes 26 is in alignment with the direction of movement "A" of the web substrate 14. This position of the manifold 16 provides the minimum distance between fluid lines 12 being applied to the substrate 14. As shown, with the spray nozzle axes 26 in alignment with each other along the imaginary transverse axis 42, the spray nozzles 24 coincide or align with each other in the direction of movement "A" of the web substrate 14 so that the fluid lines 12 overlap providing a single fluid line 12 on the substrate. It should be clearly understood from the foregoing description that the distance between the fluid lines 12 can be infinitely varied between the maximum and minimum distances.

Figure 7:
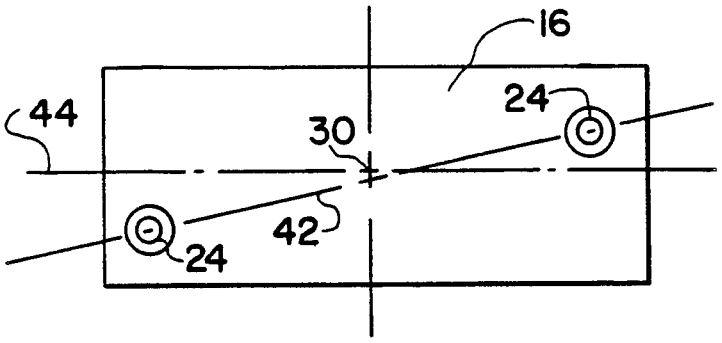
FIG. 7 is a plan view of another embodiment of the applicator of FIGS. 4 through 6.

With reference to FIG. 7, the manifold 16 is elongated in plane view, and the spray axes 26 of the spray nozzles 24 are staggered to either lateral side of the longitudinal axis 44 of the manifold 16 such that the imaginary transverse axis 42 between the nozzle spray axes 26 intersects the manifold's longitudinal axis 44 at an acute included angle.

The foregoing detailed description is given primarily for clearness of understanding and no unnecessary limitations are to be understood therefrom for modifications will become obvious to one skilled in the art upon reading this disclosure and may be made without departing from the spirit of the invention and scope of the appended claims.

What is claimed is:

1. In a glue applicator of unitary construction for applying multiple lines of a glue to a substrate comprising:

a manifold having a plurality of fluid flow passages with a like plurality of spaced fluid outlets at one side of the manifold, and at least one fluid inlet, the improvement comprising:

fluid spray nozzles attached to the manifold in fluid flow communication with the fluid outlets of the manifold passages, said outlets diverging conjointly from said inlet whereby each outlet is in direct fluid flow communication with said inlet, said nozzles extending a pre-selected distance from said manifold, said distance being such that said nozzles are spaced adjacent to one side of said substrate; and, swivel mounting means coupled to the manifold allowing the manifold to pivot about an axis parallel to the spray axes of the nozzles.

2. The applicator of claim 1, wherein the swivel mounting means is coaxial with the at least one fluid inlet of the manifold passages.

3. The applicator of claim 1, wherein the pivot axis of the swivel mounting means is located between the spray axes of the nozzles.

4. The applicator of claim 1, further comprising fluid supply conduit means in fluid flow communication with the at least one fluid inlet of the manifold passages.

5. The applicator of claim 1 wherein said outlets comprises two outlets formed in a V-shaped configuration.

* * * * *